United States Patent [19]

Poschlod

[11] 4,301,568

[45] Nov. 24, 1981

[54] REFUSE COLLECTION DEVICES

[75] Inventor: Fridolin Poschlod, Hanover, Fed. Rep. of Germany

[73] Assignee: Schorling GmbH & Co. Waggonbau, Hanover-Linden, Fed. Rep. of Germany

[21] Appl. No.: 110,472

[22] Filed: Jan. 8, 1980

[30] Foreign Application Priority Data

Jan. 15, 1979 [DE] Fed. Rep. of Germany ..... 2901355

[51] Int. Cl.[3] ..... A47L 5/12

[52] U.S. Cl. ..... 15/340; 15/420

[58] Field of Search ..... 15/340, 346, 419, 420

[56] References Cited

U.S. PATENT DOCUMENTS

| | | | |
|---|---|---|---|
| 3,201,819 | 8/1965 | Wilgus | 15/340 X |
| 3,512,206 | 5/1970 | Young | 15/340 X |
| 3,837,038 | 9/1974 | Kimzey et al. | 15/340 X |
| 3,984,894 | 10/1976 | Brock et al. | 15/419 X |
| 4,138,762 | 2/1979 | Jost | 15/419 |

FOREIGN PATENT DOCUMENTS

| | | | |
|---|---|---|---|
| 1046341 | 10/1966 | United Kingdom | 15/340 |

*Primary Examiner*—Chris K. Moore

*Attorney, Agent, or Firm*—Mason, Mason and Albright

[57] ABSTRACT

A refuse collection device comprises a refuse inlet for connection to a suction duct of a refuse collecting container mounted on a vehicle. Resilient elements surround the periphery of the refuse inlet and form a seal between the refuse inlet and a surface over which the inlet is travelling. A roller froms one of the resilient elements and is mounted across a front portion of the periphery of the refuse inlet. The roller has a resilient surface which deforms to allow objects to pass beneath the roller without reducing substantially the seal provided by the roller.

6 Claims, 2 Drawing Figures

REFUSE COLLECTION DEVICES

BACKGROUND OF THE INVENTION

1. Field of the Invention

The invention relates to a refuse collection device for a refuse collection vehicle having a refuse collecting container and a suction duct for sucking refuse into the container, the suction duct being connected at one end to the container and at the other end to the refuse collection device.

2. Description of the Prior Art

Refuse collection vehicles which operate by suction are generally fitted with a collection device. This includes a suction mouth which is suspended from a chassis of the vehicle by means of a guide linkage, and is held at a constant height above the surface being cleared of refuse by means of supporting wheels. The suction mouth is connected by the suction duct to the refuse container which is kept at a pressure below atmospheric pressure by means of a fan.

An adequate suction force at the inlet to the suction mouth is maintained by sealing the suction mouth on the sides and at the rear with resilient elements. On the front of the suction mouth provision is also made for a sealing element which, however, leaves free in the bottom area a suitable gap for the passage of objects to the suction mouth.

For the collection of sizeable refuse, e.g. heaps of leaves, stones, etc., this sealing element has been constructed so as to fold upwards. This arrangement, however, suffers from the drawback that, on upward folding of the element, which is described in normal practice as a "heavy collection flap", the entire inlet section of the suction mouth is opened. The consequence of this is a reduction in pressure in the entire suction air system; accordingly, the suction power and the collection capability of the vehicle is also reduced.

A object of the invention is to provide an improved collection device which on the collection of sizeable refuse has an approximately constant suction force at an inlet of the collection device.

SUMMARY OF THE INVENTION

According to a first aspect of the invention, there is provided a collection device for a refuse collection vehicle having a refuse collection container and a suction duct for sucking refuse into the container, the suction duct being connected at one end to the container and at an opposite end being connectable to the collection device, the collection device comprising a refuse inlet for connection to the suction duct, resilient elements surrounding the periphery of the refuse inlet and for forming a seal between the refuse inlet and a surface over which the inlet is travelling, a roller forming one of said resilient elements, mounting means rotatably mounting said resilient roller across a front portion of the periphery of the refuse inlet, and a resilient surface on said roller.

According to a second aspect of the invention, there is provided a refuse collection device for a refuse collection vehicle having a refuse collecting container and a suction duct for conveying collected refuse to the container, the collection device comprising a refuse inlet for connection to the suction duct, a suction mouth opening onto a surface from which the refuse is to be collected, elements arranged around the suction mouth for forming a seal between the surface and the suction mouth, a rotatable roller forming one of the elements disposed along a leading edge of the suction mouth, a resilient surface on the roller whereby when a roller passes over an object the resilient surface deforms to allow the object to pass the roller without reducing the seal provided by the roller.

According to a third aspect of the invention, there is provided a refuse collection vehicle comprising a refuse collecting container and a suction duct for sucking refuse into the container, the suction duct being connected at one end thereof to the container and at an opposite end thereof to a collection device comprising a refuse inlet for connection to the suction duct, resilient elements surrounding the periphery of the refuse inlet and for forming a seal between the refuse inlet and a surface over which the inlet is travelling, a roller forming one of said resilient elements, mounting means rotatably mounting said resilient roller across a front portion of the periphery of the refuse inlet, and a resilient surface on said roller.

The following is a more detailed description of one embodiment of the invention, by way of example, reference being made to the accompanying diagrammatic drawings.

DESCRIPTION OF THE PREFERRED EMBODIMENT

Figure 1:
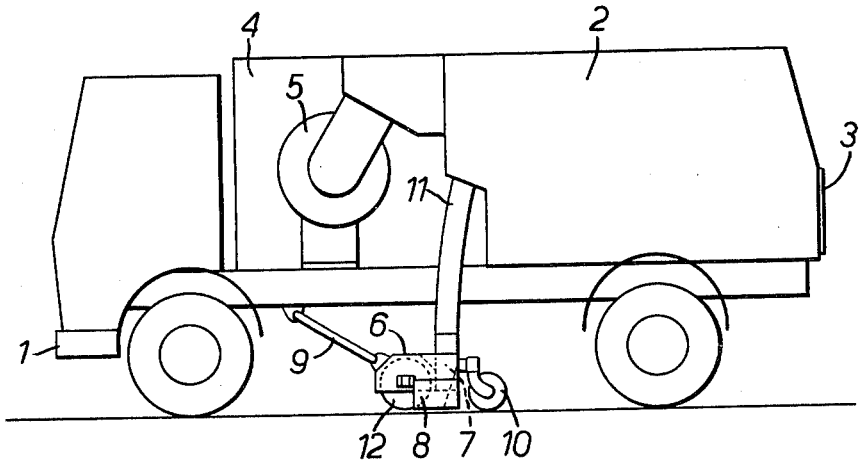
FIG. 1 is a side view of a refuse collection vehicle which is equipped with a collection device.

Referring first to FIG. 1, a chassis of the refuse collection vehicle has mounted thereon a refuse separation and collection container 2 which can be tilted rearwardly about a horizontal axis, for emptying through an emptying flap 3. A compartment 4 for machinery is disposed in front of the container 4 and contains a motor fan unit 5. The actual sweeping and collection device 6 is suspended between front and rear axles of the lorry.

The collection device 6 consists of a suction mouth 7, sealing elements 8, 8', 8'', carrying and guiding gear 9 and supporting wheels 10. The device 6 is connected, by means of a folding suction hose 11, with the refuse container 2 and supports a roller 12 which has a surface that is highly resilient in radial direction and which is mounted by mounting means for rotation about an axis which is disposed transverse to the direction of travel of the refuse collection vehicle. As seen in FIG. 1, the roller 12 is mounted across a leading end of the mouth 7, in the direction of forward travel of the vehicle.

Figure 2:
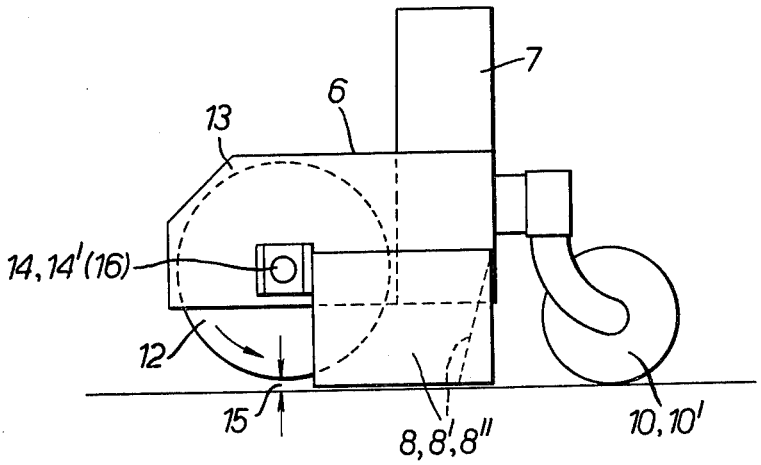
FIG. 2 is a view on an enlarged scale of the collection device of FIG. 1.

The collection device, as seen in FIG. 2, has a supporting frame 13 which carries the suction orifice 7, the sealing elements 8, 8', 8'', the supporting wheels 10, 10' and the roller 12. The sealing elements 8, 8', 8'' form a seal between the ground and two side edges and a rear edge of the suction mouth. The roller 12 is mounted on the outer surface of both sides of the device and forms a seal between the ground and the leading end of the suction mouth. The mountings 14, 14' are vertically adjustable and lockable so that the size of an air gap 15 between the roller 12 and the ground, for suction air, can be adjusted to a required size. The adjustment of the height of the roller 12 may be effected, for example, by means of screw jacks or other mechanical, electrical or pressure-controlled devices which, for the sake of simplicity, are not shown in the Figures. A driving member 16, for rotating the roller 12 in direction of the arrow shown therein, is mounted on one of the mountings 14, 14'.

In use, the fan unit 5 creates and reduces the pressure in the container 2 to below atmospheric pressure. Air is thus drawn into the suction mouth 7 and passes through the hose 11 to the container. The sealing elements 8, 8', 8'' and the roller 12 control the suction force and to ensure an adequate suction force the lower edges of these elements and the roller should be close to the ground.

On driving over, or on collecting sizeable refuse, the refuse rolls under the roller 12, with the result that the relevant part of the roller adapts itself exactly to the outlines of the large item of refuse concerned, e.g. a heap of leaves or a stone. Thus, no unnecessary widening of the preset air inlet section takes place and there is no substantial loss of suction.

The device described above with reference to the drawings does not depend for its operation on the type of the supporting chassis nor on the manner of construction of the refuse collection vehicle. The roller 12 can also be installed in collection devices which do not correspond, or correspond only partly, with the features of the collection device described with reference to the accompanying drawings.

I claim:

1. A collection device for a refuse collection vehicle having a refuse collecting container and a suction duct for sucking refuse into the container, the suction duct being connected at one end to the container and at an opposite end being connectable to the collection device, the collection device comprising:

a refuse inlet for connection to the suction duct, resilient elements surrounding the periphery of the refuse inlet and for forming a seal between the refuse inlet and a surface over which the inlet is travelling, a roller forming one of said resilient elements and extending generally across a front portion of the periphery of the refuse inlet, mounting means rotatably mounting said roller, and a resilient surface on said roller for deforming exactly to the shape of items which pass under the roller whereby to prevent a reduction in the suction as such items are encountered.

2. A collection device according to claim 1 wherein the mounting means mount the roller for rotation about an axis which is transverse to the direction of forward travel of the refuse collection vehicle.

3. A collection device according to claim 1 wherein adjusting means are provided for adjusting the position of the roller relatively to the remainder of the collection device in a vertical direction, the adjusting means including a lock for locking the roller in a required vertical position.

4. A collection device according to claim 1 wherein drive means are provided for rotating the roller.

5. A refuse collection device for a refuse collection vehicle having a refuse collecting container and a suction duct for conveying collected refuse to the container, the collection device comprising:

a refuse inlet for connection to the suction duct, a suction mouth opening onto a surface from which refuse is to be collected, elements arranged around the suction mouth for forming a seal between the surface and the suction mouth, a rotatable roller forming one of the elements disposed along a leading edge of the suction mouth, a resilient surface on the roller whereby when a roller passes over an object the resilient surface deforms to allow the object to pass the roller without reducing the seal provided by the roller.

6. A refuse collection vehicle comprising a refuse collecting container and a suction duct for sucking refuse into the container, the suction duct being connected at one end thereof to the container and at an opposite end thereof to a collection device comprising a refuse inlet for connection to the suction duct, resilient elements surrounding the periphery of the refuse inlet and for forming a seal between the refuse inlet and a surface over which the inlet is travelling, a roller forming one of said resilient elements and extending generally across a front portion of the refuse inlet, mounting means rotatably mounting said roller for rotation about an axis extending normal to the direction of travel of the device, and a surface on said roller which is highly resilient in a radial direction of the roller whereby, when sizable refuse rolls under the roller, the relevant part of the roller adapts exactly to the outlines of the sizable refuse thus preventing unnecessary widening of the gap between the roller surface and the surface over which the inlet is travelling and preventing any substantial loss of suction.

* * * * *